US007509703B2

(12) United States Patent
Martin

(10) Patent No.: US 7,509,703 B2
(45) **Date of Patent: *Mar. 31, 2009**

(54) ROLLER HUB WITH COVER AND LOADING DEVICE

(75) Inventor: Floyd E. Martin, Bremerton, WA (US)

(73) Assignee: Hyde Tools. Inc., Southbridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/949,838

(22) Filed: Dec. 4, 2007

(65) Prior Publication Data

US 2008/0141480 A1 Jun. 19, 2008

Related U.S. Application Data

(63) Continuation of application No. 10/379,240, filed on Mar. 3, 2003, now Pat. No. 7,337,488.

(60) Provisional application No. 60/360,772, filed on Mar. 1, 2002.

(51) Int. Cl.
*B05C 17/02* (2006.01)
*B05C 21/00* (2006.01)

(52) U.S. Cl. ..... 15/230.11; 492/19

(58) Field of Classification Search ..... 15/230.11; 492/19

See application file for complete search history.

(56) References Cited

U.S. PATENT DOCUMENTS 2,538,241 A * 1/1951 Guimond ..... 15/230.11
2,685,100 A * 8/1954 Schaefer ..... 15/230.11
2,929,089 A * 3/1960 Nall ..... 15/230.11
2,994,899 A * 8/1961 Moilanen ..... 15/244.2
3,159,905 A * 12/1964 Baggett, Jr. ..... 492/19
3,662,422 A * 5/1972 Christensen et al. ..... 15/230.11
4,197,338 A * 4/1980 Perna ..... 427/278
D282,882 S * 3/1986 Allison et al. ..... D32/53.1
D286,458 S * 10/1986 Pages ..... D32/53.1
4,815,604 A * 3/1989 O'Neil et al. ..... 206/518
D327,755 S * 7/1992 Boyer ..... D32/53.1
D328,808 S * 8/1992 Goetz ..... D32/53.1
5,339,484 A * 8/1994 Polzin et al. ..... 15/230.11
5,473,719 A * 12/1995 Stone ..... 385/123
5,473,791 A * 12/1995 Holcomb et al. ..... 15/230.11
D403,866 S * 1/1999 Lapre ..... D4/122

FOREIGN PATENT DOCUMENTS

DE 297 00 592 * 4/1997
JP 2001009350 * 1/2001
WO WO 81/02397 * 9/1981

* cited by examiner

*Primary Examiner*—Randall Chin
(74) *Attorney, Agent, or Firm*—Lackenbach Siegel, LLP

(57) ABSTRACT

A liquid loading and application apparatus includes a hub, a paint roller support element, and the hub receives the paint roller support element. The hub includes first and second frusto-conical surfaces subtending an angle, and oppositely disposed annular end surfaces contiguous with the respective first and second frusto-conical surfaces. A cover of a first material conforms to the frusto-conical surfaces. The cover has opposed circular openings, and elastic strips of a second material. The elastic strips engage the frusto-conical surfaces and grippingly secure the cover to the hub. The first material is more elastic than the second material so that the strips grippingly secure the cover to the hub.

9 Claims, 5 Drawing Sheets

FIG. 2
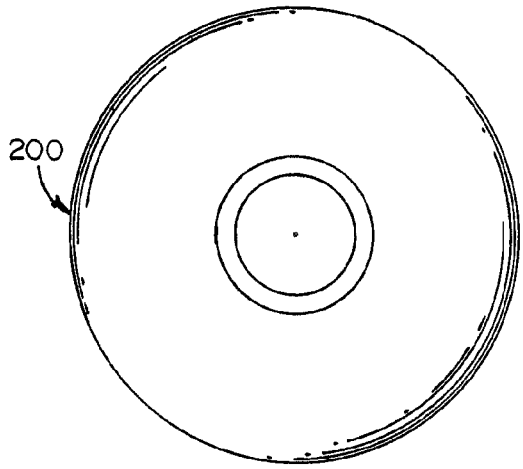
FIG. 3
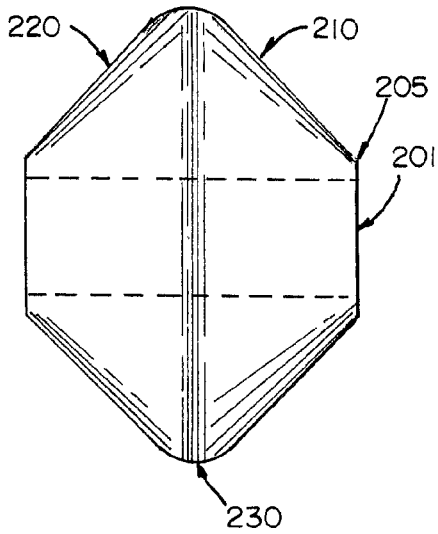
FIG. 4
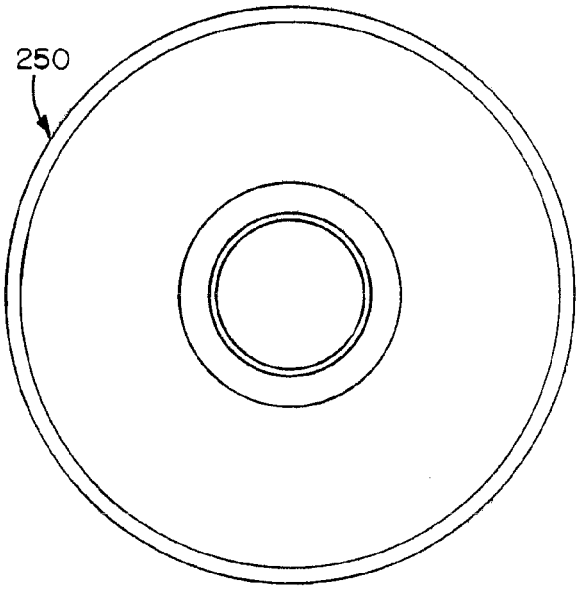
FIG. 5
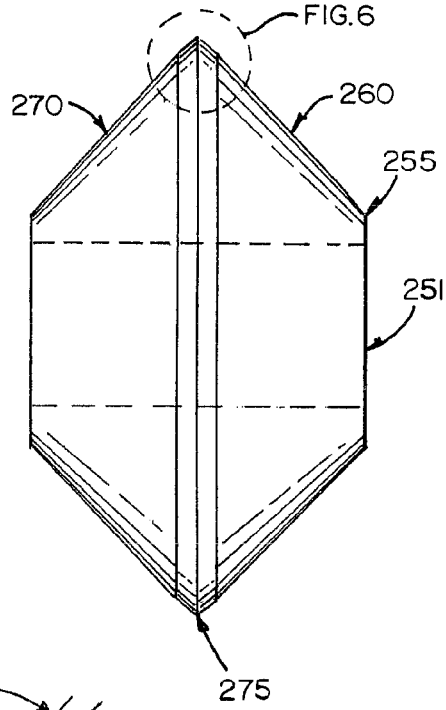
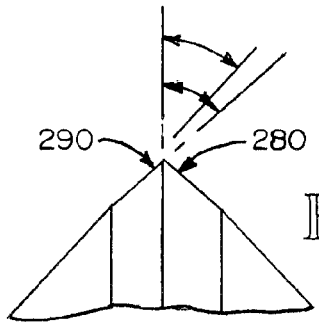
FIG. 6

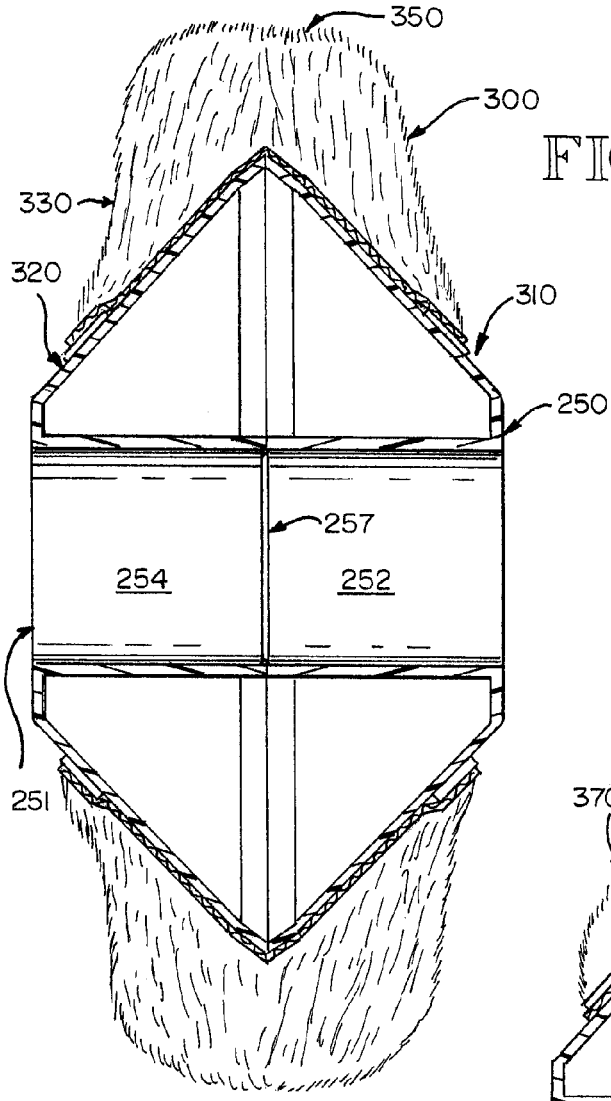
FIG. 7
FIG. 8
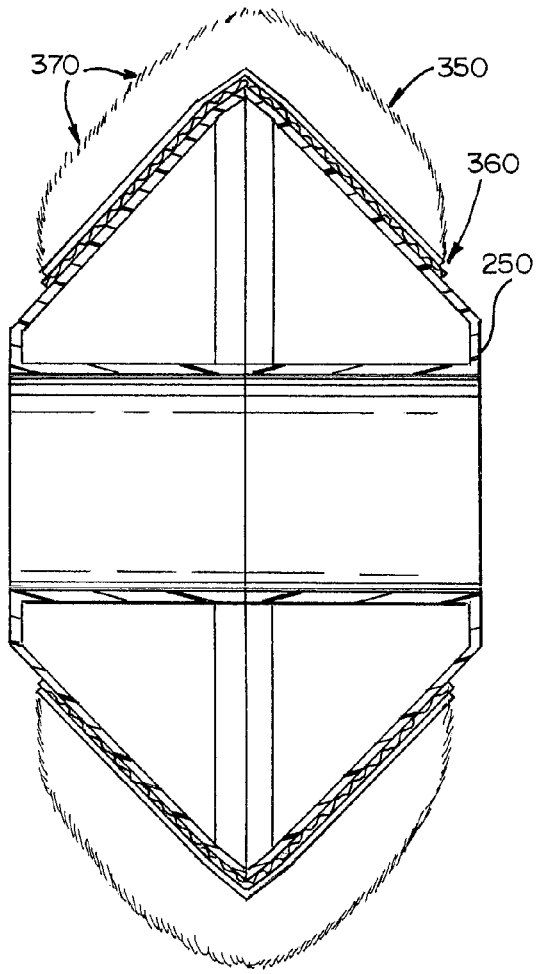

ROLLER HUB WITH COVER AND LOADING DEVICE

PRIOR RELATED APPLICATIONS

This application claims priority to U.S. Provisional Patent Application No. 60/360,772, filed Mar. 1, 2002 and is a continuation of and claims priority to U.S. Non-Provisional patent application Ser. No. 10/379,240, filed Mar. 3, 2003, now U.S. Pat. No. 7,337,488, granted Mar. 4, 2008, which applications are incorporated herein in their entireties by reference thereto.

TECHNICAL FIELD

The present invention relates generally to devices used for painting and, more particularly, to roller devices for painting and the devices used for loading paint on the roller devices.

BACKGROUND OF THE INVENTION

Roller devices are often used for painting, and trays have been especially adapted for use with the rollers. Conventional rollers have cylindrical shapes, and most trays are designed to accommodate the cylindrical rollers. For example, the following U.S. patents disclose trays especially adapted for use with conventional paint rollers: U.S. Pat. Nos. 4,815,604; Des. 282,882; Des. 286,458; Des. 327,755; and Des. 328,808.

There are a number of deficiencies associated with conventional cylindrical rollers. For example, interior corners result from the intersection of two planar wall surfaces, generally at a right angle. Interior corners are generally painted with a brush to ensure that an adequate amount of paint gets into the corner. To paint such corners with a conventional cylindrical roller would require at least two passes if one were an extremely proficient painter, but generally many passes are required. To save time in painting, it would be desirable if an interior corner of a room could be painted with a roller with only one pass required to paint both walls near the intersection at the corner.

Trays that are used with conventional cylindrical rollers generally have two major tray areas. There is one area for loading the roller with paint, and there is a second area on which excess paint can be squeezed out of the roller. In this respect, it would be desirable if a device were provided that would load a roller designed to paint two wall surfaces at an interior corner simultaneously in such a manner that the roller would have enough paint in the center of the roller so that the crevices of the corner could be painted, but less paint near the edges of the roller so that there would be no excess paint left on the walls. Such a device should also include an area especially adapted for squeezing excess paint out of a roller designed to paint two wall surfaces at an interior corner simultaneously.

U.S. Pat. No. 5,473,791, issued to Holcomb et al. ("the Holcomb patent"), discloses a paint roller and tray apparatus designed to address the deficiencies of conventional rollers for use in painting corners. The Holcomb patent discloses a roller with two adjacent canted peripheral edges that form a sharp angle. The sharp angle of the roller disclosed in the Holcomb patent is complementary to the angle of most interior corners encountered when painting. The roller disclosed in the Holcomb patent is made from absorbent material such as sponge or foam-like material.

The tray disclosed in the Holcomb patent is similar to the trays used for loading conventional cylindrical rollers in that it is a roughly rectangular pan with an open top that includes a pool region adapted to contain a quantity of coating material. The tray disclosed in the Holcomb patent also includes a squeeze area adjacent to the pool region for receiving the roller portion for squeezing out excess coating material from the roller portion. The squeeze area includes a slot with canted walls that are complimentary to the canted walls of the roller.

While it is an improvement over the use of conventional cylindrical rollers for painting interior corners, the roller disclosed in the Holcomb patent has several deficiencies. The use of sponges or foam-like material for the roller does not allow the roller to be loaded in a manner that puts the most paint in the corner where it is needed. The material used in the roller can become over saturated with coating material causing excess material to run down the walls and stain the floor covering. The design of the roller includes a sharp angle at the location where the two canted edges meet and this forces covering material out of the corner, past the canted edges, and onto the adjacent walls.

The sponge or foam rollers disclosed in the Holcomb patent do not allow a user to change the nap of the roller to ensure even coverage of textured surfaces. To change the roller of the Holcomb patent, a user must take the entire roller off of the rolling device, and the entire roller must then be cleaned or disposed of. The tray assembly disclosed in the Holcomb patent does not include a carrying handle and is difficult to move from room to room without spilling paint when the pan is full.

Thus, while the foregoing body of prior art indicates it to be well known to use conventional cylindrical paint rollers and trays, and teaches the use of a sponge or foam roller with canted walls for painting corners, it does not teach or suggest a paint roller and loading device which has the following combination of desirable features: (1) permits an interior corner of a room to be painted with a roller with only one pass required to paint both walls near the corner; (2) allows a user to change naps when painting different textured surfaces; (3) places more paint in the corner than on the adjacent walls; (4) allows the painting surface of the roller to be cleaned or disposed of separately from the roller hub; (5) can be used in a variety of different ways to apply paint to a multitude of surfaces; and (6) includes a device especially adapted for properly loading paint into a special roller designed to paint two wall surfaces at an interior corner simultaneously, and that can be placed inside a conventional paint bucket and therefore be easily moved without fear of spillage. The foregoing desired characteristics are provided by the unique roller hub, roller cover and paint grid of the present invention, as will be made apparent from the following description thereof. Other advantages of the present invention over the prior art also will be rendered evident.

DISCLOSURE OF THE INVENTION

As discussed herein, any reference to paint should be understood to include paint and other liquid coating materials that can be applied to a surface. Additionally, any references to interior corners herein should be understood to mean a corner resulting from the intersection of two planar wall surfaces, generally at a right angle. The term interior corner should not be understood to be limited to a corner on the interior of a structure as the device disclosed herein can be used for painting both the interior and exterior of a structure.

To achieve the foregoing and other advantages, the present invention, briefly described, provides a roller hub that can be placed on standard roller frames, a removable roller cover that is placed over the hub, and a paint grid for loading paint on the roller that is designed to fit in a standard paint bucket.

The current invention discloses a roller hub that is unique in several ways. The hub is designed to fit standard roller frames. The hub is constructed of plastic or other material that is sufficiently strong to allow substantial pressure to be applied by a painter to ensure that paint fills the corners and any cracks effectively and without repeated applications. The paint loading surface of the hub is formed from two surfaces that are oriented at a generally 90° angle. The intersection of the two surfaces is rounded to allow a channel for excess paint to flow when the roller is loaded and pressed into operation in a corner, or the paint loading surfaces can intersect additional surfaces which then intersect at a greater than a 90° angle thereby allowing a channel as previously discussed.

The invention discloses a removable, reusable cover that slips over the hub and is held in place by material with a high degree of elasticity. The roller cover is also unique in that the length or thickness of the nap on the edges is shorter than the length or thickness of the nap in the middle, thereby allowing more paint to be loaded in the area of the roller where it is most needed, the corner. The roller cover is made from lambs wool or similar synthetic fiber, and the back of the cover is a porous synthetic material allowing for an easier cleaning process than other rollers.

The shape of the uniquely designed paint grid disclosed by the invention matches the shape of the roller hub. The grid allows a painter to load the multi-length nap of the roller cover with the correct amount of paint with more paint loaded on the thicker nap than at the edges.

When using the hub and cover disclosed herein, one can paint corners, turn the roller on its side and paint as with a paint brush or hold the roller at a 45° angle and use the device as a two-inch roller for flat surfaces.

BRIEF DESCRIPTION OF THE DRAWINGS

The advantages of the hub, cover, and loading grid disclosed above, and other advantages that would be obvious to one of ordinary skill in the art, will be better understood after a study of the following detailed description of the invention. The description makes reference to the attached drawings wherein:

FIG. 2 is a side elevation view showing one embodiment of the hub of the current invention;

FIG. 3 is an end elevation view showing the embodiment of the current invention shown in FIG. 2;

FIG. 4 is a side elevation view showing another embodiment of the hub of the current invention;

FIG. 5 is an end elevation view showing the embodiment of the current invention shown in FIG. 4;

FIG. 6 is a more detailed view of the apex of the hub depicted in FIGS. 4 and 5;

FIG. 7 is a cross-sectional end view showing one preferred embodiment of the cover of the current invention placed on a hub;

FIG. 8 is a cross-sectional end view showing another preferred embodiment of the cover of the current invention placed on a hub;

Turning now to the drawings, the invention will be described in preferred embodiments by reference to the numerals of the drawing figures wherein like numbers indicate like parts.

FIG. 1 shows a preferred embodiment of the hub 250, cover 300, and loading grid 400 of the current invention. The hub 250 is designed so that a standard roller frame 102 can be inserted into the hub. In a preferred embodiment, a standard three-inch frame is used, but other frame sizes can be used for other embodiments of the current invention so long as the entire cage portion 102 of the roller frame is covered.

FIG. 2 and FIG. 3 show one preferred embodiment of the hub 250 of the current invention having a channel 201 for the insertion of a standard roller frame. The paint loading surfaces 210 and 220 are angled inward from the sidewalls 205 such that they would intersect at a generally 90° angle. Corner 230 is rounded such that when the cover is loaded and pressed into a corner, there is a gap between the cover and the corner thereby creating a channel for excess paint flow.

Figure 1:
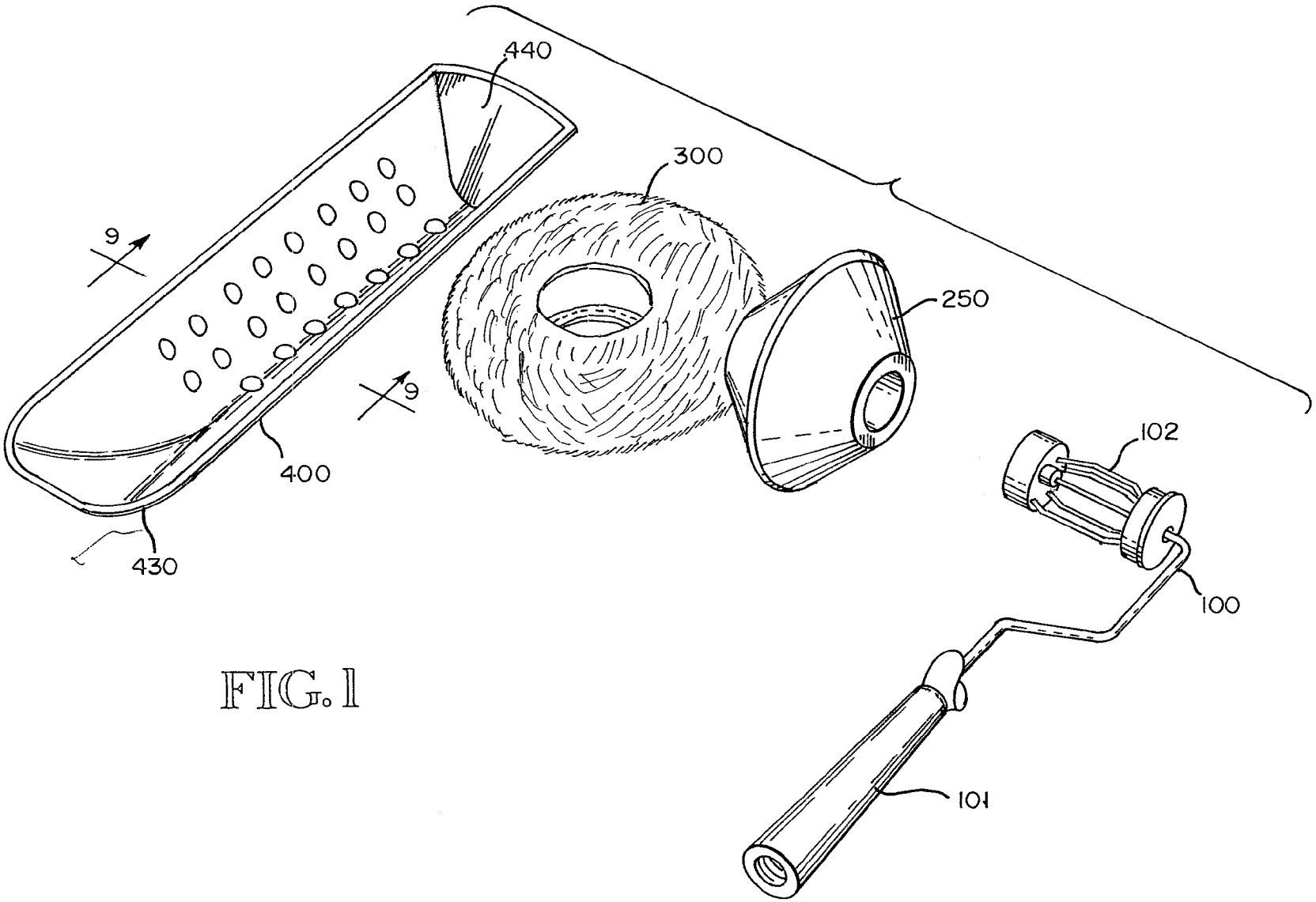
FIG. 1 depicts the hub, cover, and loading grid of the current invention and a standard roller frame.

The rounded corner allows for more paint to be applied to the corner than the adjacent walls, thereby ensuring that paint fills the corners and any cracks effectively without repeated applications. The preferred range for the radius of the curve for the rounded corner is approximately 0.125 inch to 0.50 inch, the broadest range for the radius of the curve is from approximately 0.10 inch to 0.75 inch, and the radius of the curve for the rounded corner in one preferred embodiment is approximately 0.375 inch.

The sidewalls 205 on this embodiment and the sidewalls 255 of the embodiment depicted in FIG. 4 through FIG. 6, serve to keep the curved portion of the handle 101, adjacent to the cage 102 on a standard roller frame 100, from scuffing the walls when the apparatus of the current invention is used to paint an interior corner. Additionally, the shape of the hub allows the roller frame to be held at an approximately 45° angle from a flat surface and the apparatus can be used in a manner similar to a standard roller without the handle striking the surface. Another advantage of the sidewalls is that they prevent the ends of the cage 102 from striking a surface upon which paint is being applied.

The hubs of the current invention are constructed of plastic or other material that is sufficiently strong to allow substantial pressure to be applied by a painter to ensure that paint fills the corners and any cracks effectively and without repeated applications.

FIG. 4 through FIG. 6 shows another preferred embodiment of the hub 250 of the current invention having a channel 251 for the insertion of a standard roller frame. The paint loading surfaces 260 and 270 are angled inward from the sidewalls 255 such that they are oriented at a generally 90° to each other. Each of the loading surfaces 260 and 270 intersect with one of a pair of corner surfaces 280 and 290, such that the interior angle between the loading surface and the corner surface is greater than 90°. The corner surfaces 280 and 290 intersect with each other such that the interior angle between the surfaces is greater than 90°. This configuration allows for a gap between the cover and the corner when the cover is loaded and pressed into a corner, thereby creating a channel for excess paint flow. The channel allows more paint to be applied to the corner than the adjacent walls, thereby ensuring that paint fills the corners and any cracks effectively without repeated applications.

FIG. 7 shows one preferred embodiment of the cover 300 placed on a hub 250 according to the current invention. As can be seen in FIG. 1, before the cover is placed on the hub it is generally donut shaped with an arch shaped cross section. Once placed on the hub 250 the cover 300 conforms to the hub. In this embodiment, the cover 300 is held on the hub 250 by two strips of elastic material 310 and 320, which are attached to the interior surface of the cover near the edges of the cover. The nap 330 at the edges of the cover is shorter than the nap 350 in the center of the cover. This allows a lager volume of paint to be loaded in the center of the cover, thereby ensuring that paint fills the corners and any cracks effectively and without repeated applications.

The roller cover is a removable, reusable cover that slips over the hub and is held in place by material with a high degree of elasticity. It is made from lambs wool or similar synthetic fiber, and the back of the cover is a porous synthetic material allowing for an easier cleaning process than other rollers. The preferred range for the length of the nap on the edges of the covers is approximately 0.125 inch to 0.375 inch, the broadest range is approximately 0.10 inch to 0.50 inch, and the length of the nap on the edge of the roller cover of one preferred embodiment is approximately 0.25 inch. The preferred range for the length of the nap at the center of the covers is approximately 0.40 inch to 1.75 inches. The broadest range is approximately 0.375 inch to 2 inches. The length of the nap at the center of the roller cover of one preferred embodiment is approximately 1.25 inches. Another advantage of the long nap in the center of the roller cover is that the roller can also be used as a brush by turning it on its side and moving it up and down at generally right angles to the direction of rotation.

As can also be seen in FIG. 7 the hub 250 is constructed from two identically shaped pieces 252 and 254, which are connected at a seam 257. When the two pieces 252 and 254 are connected, they are slightly off set from each other so that the two sides of the channel 251 have an almost undetectable asymmetry. When a roller frame is inserted into the channel, the asymmetry in the channel causes the roller to become firmly wedged in the channel such that the hub 250 will not slide off of the roller frame when the apparatus of the current invention is in use.

FIG. 8 shows another preferred embodiment of the cover 350 of the current invention. In this embodiment, the nap 370 is a uniform length on the entire exterior surface of the cover 350. Although the two strips of elastic material described above can be used to hold the cover of any embodiment on the hub, FIG. 8 depicts an alternate way to hold the cover on the hub. A thin layer of elastic material 360 is attached to the entire interior surface of the cover for holding the cover on the hub 250.

Referring again to FIG. 1, the grid 400 is an elongated trough with a cross-sectional shape that is complimentary to the hub of the current invention. The grid is constructed from a non-porous material and has a bottom end 430 that is curved for resting on the bottom of a paint bucket and a top end 440 that is defined by an angled end wall.

Figure 9:
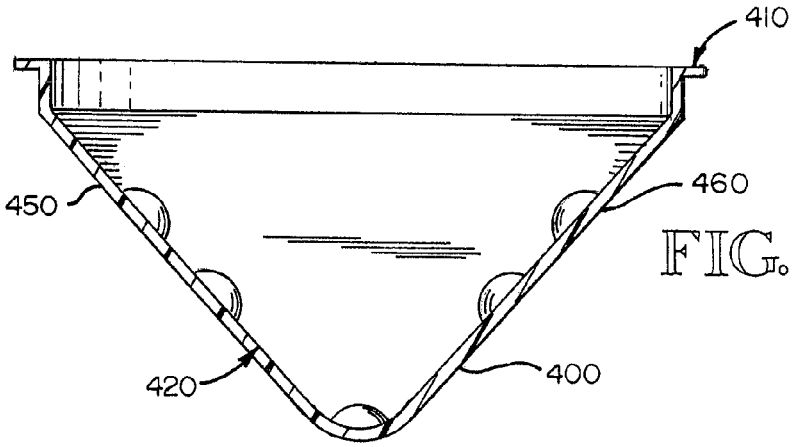
FIG. 9 is an end elevation view along the long axis of the current invention showing the cross-sectional shape of the loading grid.

FIG. 9 shows a cross sectional view of the loading grid 400 of the current invention. The grid 400 has a reinforcing rim 410, which provides stability and keeps the grid from collapsing when pressure is applied while loading the cover of the current invention. The wide walls 450 and 460 will engage the loading surfaces of the hub. In one preferred embodiment, the grids are designed to fit into a standard five-gallon paint bucket.

The non-porous grid 400 serves three functions. First, the grid provides a surface for forcing paint into the nap of the covers disclosed herein. Second, the shape of the grid distributes the paint in the cover such that more paint is in the nap at the center of the cover than in the nap on the sides of the cover. Third, once the cover is sufficiently loaded, the grid can be used to squeeze any excess paint out of the cover.

The interior surface of the loading grid includes a plurality of knobs 420 to facilitate the loading, distributing and squeezing paint in the cover. The knobs 420 can be made in any shape and placed in any pattern, and in the preferred embodiment depicted they are semispherical in shape. The grids of the current invention are constructed of plastic or other non-porous material that is sufficiently strong to allow substantial pressure to be applied by a painter to squeeze excess paint out of the covers of the current invention.

Figure 10:
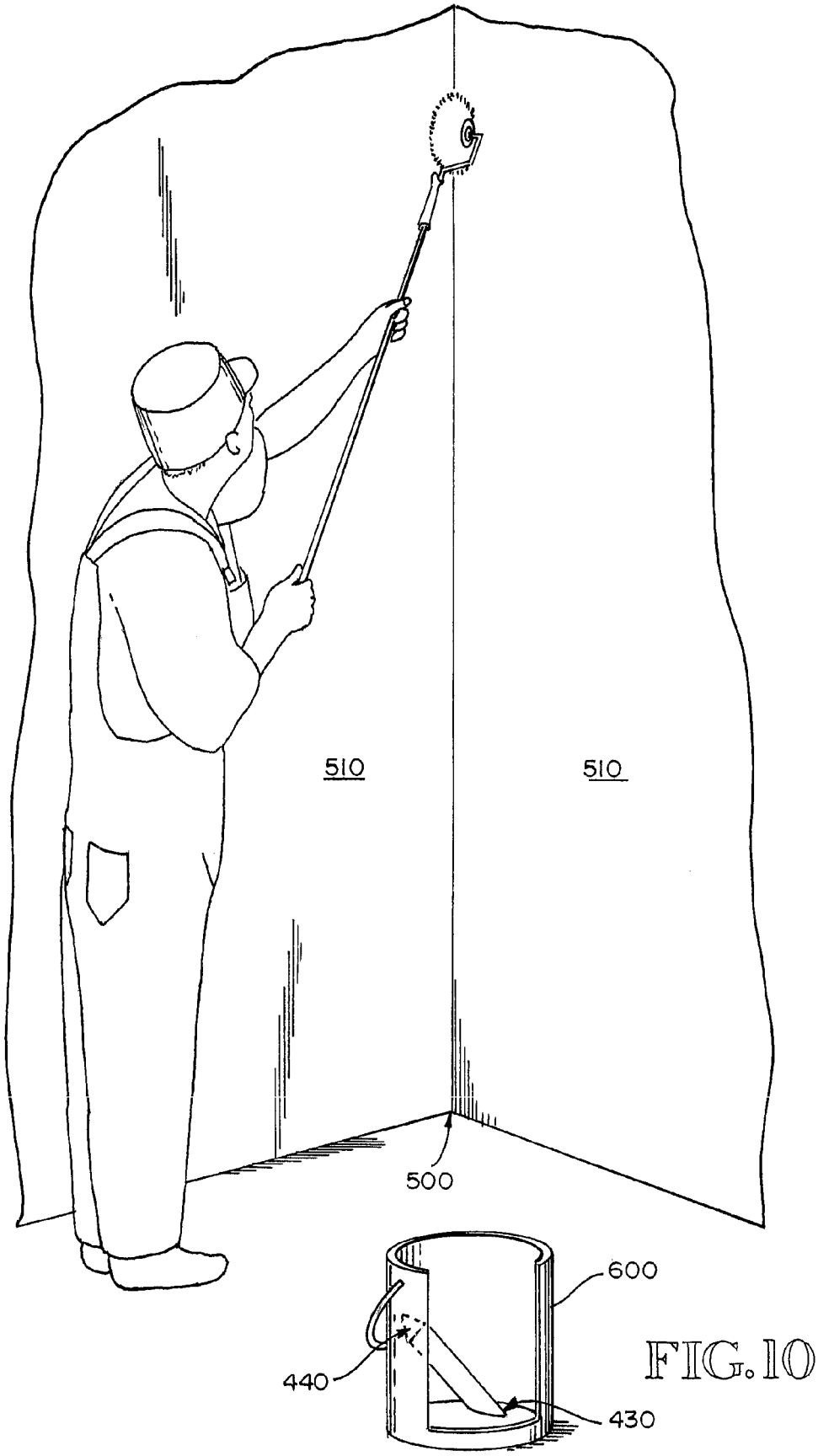
FIG. 10 is a perspective view showing the current invention in use, and cross sectional view of a standard paint bucket with a loading grid inserted into the bucket according to the teachings of the current invention.

FIG. 10 shows the apparatus of the current invention in use. A standard roller frame is placed in the channel of the hub, and the cover is placed over the hub. The loading grid 400 is placed inside a standard paint bucket 600 such that the bottom end rests against the side of the bucket on the bottom of the bucket and the top end 440 rests against the opposite side of the bucket above the bottom end. To keep the top end from sliding along the wall of the bucket, a small amount of paint can be placed on the exterior surface of the top end to provide adhesion with the wall.

The bucket is filled approximately one-quarter to one-third full with paint or other liquid coating material, and the cover is loaded by placing the cover and roller. The cover is loaded by placing it in the grid and rolling it along the long axis of the grid into the paint and then out of the paint repeatedly until the desired paint load is achieved. As the roller rotated through the grid the knobs to remove excess paint from the edges of the cover. The apparatus is then placed against an interior corner and rotated upward or downward along the corner thereby dispensing paint into the corner and on the walls adjacent to the corner.

Figure 11:
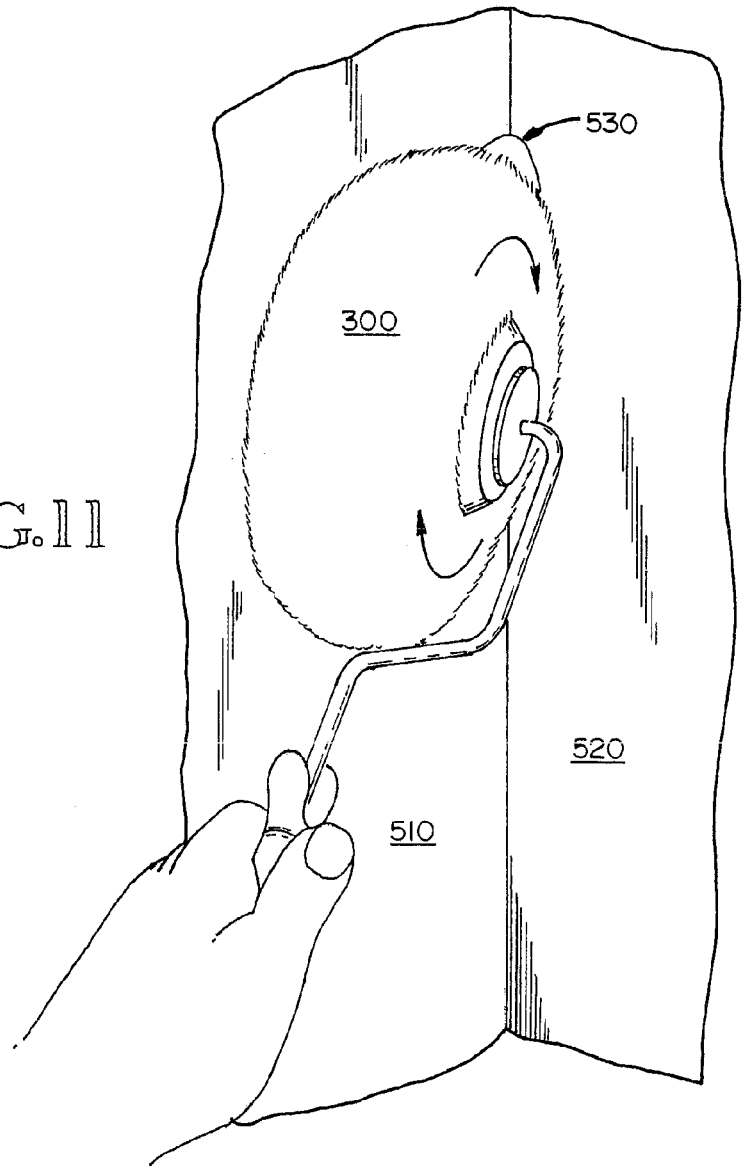
FIG. 11 is a perspective view of the current invention in use.

FIG. 11 is another depiction of the current invention in use. The apparatus is placed against an interior corner and rotated. The gap between the apparatus and the corner, described above, allows a channel so that the paint located in the center of the cover can flow freely from the cover 530. The paint is evenly and smoothly applied to the corner, and the excess paint flows outward where it is applied to the walls adjacent to the corner.

As noted above, the apparatus of the current invention can also be used to paint in a manner similar to that of a brush by simply moving the roller at generally right angles to its direction of rotation, or the roller handle can be held at an approximately 45° angle and the invention can be used in a manner similar to a standard paint roller. The covers and hubs disclosed herein are suitable for use with all sheen levels used for liquid covering materials. The invention disclosed herein is relatively durable and inexpensive to make. It permits an interior corner of a room to be painted with a roller with only one pass required to paint both walls near the corner and allows a user to change naps when painting different textured surface.

The current invention provides an apparatus that allows the painting surface of a roller to be cleaned or disposed of separately from the roller hub. The apparatus disclosed herein can be used in a variety of different ways to apply paint to a multitude of surfaces; and includes a device especially adapted for properly loading and squeezing excess paint out of a special roller designed to paint two wall surfaces at an interior corner simultaneously, and that can be placed inside a conventional paint bucket and therefore be easily moved without fear of spillage.

DESCRIPTION OF THE INVENTION

The invention has applicability to the field of devices used to apply a liquid coating material to a surface and, more particularly, to roller devices for and the grid devices used for loading the roller devices. In compliance with the statute, the invention has been described in language more or less specific as to structural features. It is to be understood, however, that the invention is not limited to the specific features shown or described, since the means and construction shown or described comprise preferred forms of putting the invention into effect. Additionally, while this invention is described in terms of being used for applying paint, it will be readily apparent to those skilled in the art that the invention can be adapted to other uses as well, and therefore the invention should not be construed as being limited to paint application. The invention is, therefore, claimed in any of its forms or modifications within the legitimate and valid scope of the appended claims, appropriately interpreted in accordance with the doctrine of equivalents.

What is claimed is:

1. A liquid loading and application apparatus comprising:

(a) a hub, a paint roller support element, said hub comprises means for receiving the paint roller support element, said hub comprises first and second frusto-conical surfaces subtending an angle, said hub further comprises oppositely disposed circular end surfaces contiguous with the respective first and second frusto-conical surfaces;

(b) a cover, said cover comprises a first material, said cover conforms to the frusto-conical surfaces, said cover having spacedly disposed circular openings, and elastic strips, said elastic strips comprise a second material, and means for fixedly securing each said elastic strip to the cover adjacent the respective circular opening;

(c) said second material being more elastic than the first material and the elastic strips grippingly engages with respective frusto-conical surfaces so that the strips grippingly secure the cover to the frusto-conical surfaces, and a portion of each frusto-conical surface between the elastic strips and the end surfaces is uncovered with the cover disposed on the frusto-conical surfaces; and (d) whereby the elastic strips grippingly secure the cover to the hub with the cover circular openings disposed on the frusto-conical surfaces and being spacedly disposed from the hub circular end surfaces.

2. The apparatus of claim 1, said support element comprises an axially disposed elongate rod.

3. The apparatus of claim 1, said hub being hollow and said frusto-conical surfaces being spacedly disposed form the support element.

4. The apparatus of claim 1, each frusto-conical surface extends to a respective annular end face, each said annular end face being disposed adjacent the support element.

5. The apparatus of claim 1, said frame comprises a cage comprising elongate angularly disposed contiguous elements.

6. The apparatus of claim 1, said cover comprises nap fixedly secured to the outer surface of the cover, said nap extends across the cover to the circular openings.

7. The apparatus of claim 1, said hub end surfaces being planar.

8. The apparatus of claim 1, said cover comprises nap said nap being spacedly disposed from the hub end surfaces and the end surfaces are not covered by the nap.

9. The apparatus of claim 1, said cover comprises nap said nap being spacedly disposed from the hub end surfaces and the paint roller support element, wherein the liquid loaded nap engages a corner and the loaded liquid in the nap is thereby spacedly disposed from the paint roller support element.

* * * * *